United States Patent [19]

Redmond et al.

[11] Patent Number: 4,493,574

[45] Date of Patent: Jan. 15, 1985

[54] DISPENSER PACKAGE HAVING FAULT LINE PROTRUSION

[75] Inventors: Sanford Redmond, 1385 York Ave., New York, N.Y. 10021; Walter A. Mainberger, Wayne, N.J.

[73] Assignee: Sanford Redmond, New York, N.Y.

[21] Appl. No.: 442,813

[22] Filed: Nov. 18, 1982

[51] Int. Cl.[3] ..... A47L 13/17

[52] U.S. Cl. ..... 401/132; 206/469; 206/634; 222/107; 222/541; 401/196

[58] Field of Search ..... 401/132, 196; 206/469, 206/634; 604/3; 222/92, 107, 541

[56] References Cited

U.S. PATENT DOCUMENTS

| | | | |
|---|---|---|---|
| 2,103,389 | 12/1937 | Salfisberg | 221/60 |
| 2,499,313 | 2/1950 | Hoag | 206/56 |
| 2,864,108 | 12/1958 | Johnson | 15/135 |
| 2,956,710 | 10/1960 | O'Connor | 222/541 X |
| 3,048,878 | 8/1962 | Gray et al. | 15/512 |
| 3,263,863 | 8/1966 | Hoag | 222/107 |
| 3,315,801 | 4/1967 | Lowry | 206/56 |
| 3,334,790 | 8/1967 | Eaton | 222/107 |
| 3,418,059 | 12/1968 | Robe | 401/266 |
| 3,472,368 | 10/1969 | Hellstrom | 206/56 |
| 3,473,650 | 10/1969 | Hoag | 206/56 |
| 3,521,805 | 7/1970 | Ward | 222/107 X |
| 3,635,376 | 1/1972 | Hellstrom | 222/107 |
| 3,741,384 | 6/1973 | Cloud | 206/56 |
| 3,750,907 | 8/1973 | Steele | 222/107 |
| 3,759,371 | 9/1973 | Marks | 206/42 |
| 3,986,640 | 10/1976 | Redmond | 222/92 |
| 4,140,409 | 2/1979 | DeVries | 401/132 |
| 4,430,013 | 2/1984 | Kaufman | 401/132 |

*Primary Examiner*—Steven A. Bratlie

*Attorney, Agent, or Firm*—Morgan, Finnegan, Pine, Foley & Lee

[57] ABSTRACT

A dispenser package for flowable substances of the type where the flowable product is contained within a flexible pouch adhered to a relatively stiff material and may be opened along a fault line or cut pattern scored in the relatively stiff material with one hand by folding the stiff ends toward one another into a "V" shape containing one or more dimples, pyramidal shapes or other protrusions on the fault line or fault area. The protrusions not only increase and concentrate the stress forces, so that even very tough, high barrier materials may be used in constructing the package and will rupture at the protrusions by the aforesaid folding motion, but also control both the aperture shape and flow direction of the flowable substance as it is dispensed. The ability to make the package of tough materials enables the package to contain substances under pressure which subsequently will be dispensed. A sponge-like material also may be compressed within the package shaped so that a portion will project from the package on opening for use as a swab for application of the contents.

16 Claims, 20 Drawing Figures

DISPENSER PACKAGE HAVING FAULT LINE PROTRUSION

BACKGROUND AND OBJECTS OF THE INVENTION

1. Field of the Invention

The present invention relates to a dispenser package for flowable products and the like and, more specifically, to certain new and useful improvements in the configuration and structure of a dispenser package which contains and dispenses a quantity of flowable product normally called for in a single use.

2. Description of the Prior Art

Various attempts have heretofore been made to provide a dispenser package into which a flowable product may be packaged in the quantity normally required for a single use, and from which such flowable material may be dispensed. Two familiar examples of previous attempts to make such dispenser packages are: cuplike containers made of plastic or plastic coated material with covers made of plastic, foil or laminates of each, and envelope packages (pouches) made of relatively thin plastic or combinations of laminated plastics and sometimes foil.

The first type container mentioned above is most frequently used to package and dispense cream, jelly, salad dressing and products of similar viscosity. The cover is sealed to the rim of the container and covers the open top. In order to access the contents of this container, the container itself must be grasped firmly in one hand while the cover is removed with the other hand. Opposing forces must be applied to sever the cover from the rim, which often causes a variety of accidents. One typical problem is that the cover may tear and although the remaining cover can be removed, it usually results in getting some of the product on the user's fingers or, if left in place, hampers accessing the contents. Alternatively, the cover may suddenly tear away from the container rim causing the user to spill, splash or squirt the contents, often on himself or others. Since these containers must be lightweight to be economical, the vessel walls collapse under the pressure exerted upon them by the user. On moving vehicles such as aircraft, trains or automobiles, the chances of spill, splash or squirting are obviously compounded.

The other common type of package previously mentioned, the pouch made of relatively thin plastic, foil or laminates of each, suffers similar faults. These packages are most frequently encountered as containers for catsup, mustard, other condiments, homecare preparations such as hair conditioners, dyes and cremes, et al. In order to access the contents, the pouch must be held in one hand while a tearing motion and force are applied by the other hand. As with the plastic containers, creating the initial tear to break the envelope's seal is often very difficult. Moreover, once the initial tear is created, the laminated foil or plastic not only often tears in an uncontrolled fashion, but the holding pressure exerted by one of the user's hands often forces the contents out of the envelope not only before the user is ready to apply the contents, but even before the tearing motion is complete. Opening is generally so difficult that the pouch is often opened by biting the edge of the pouch.

Another disadvantage of the two types of dispenser packages just discussed is the fact that the user must in each instance use both hands to open the container.

Redmond's own U.S. Pat. No. 3,986,640 (hereinafter the 640 patent) discloses a dispenser package which represents a marked improvement over the foregoing prior package structures in that it accomplishes efficient dispensing of a predetermined quantity of the contents with a one-handed motion and without presenting the opening difficulties previously associated with opening by removal of a cover or tearing of an envelope or pouch. Briefly, in the 640 patent, the flowable product is contained within a pouch defined by a flexible sheet material and a sheet of relatively stiff material. The flexible sheet material and the sheet of relatively stiff material (or a combination of the relatively stiff material and an additional barrier layer adhered onto at least one side of the relatively stiff material) are each impervious to the flowable product. A predetermined fault line or cut pattern is scored into the sheet of relatively stiff material such that the stiff material will rupture on the fault line or cut pattern when stress is placed upon the sheet of stiff material. In the 640 patent, the relatively stiff material was scored with a variety of cut patterns to create at least one opening and a tongue, the simplest of which was a straight line cut across the center of the package. In use, the sheet of stiff material is bent into a "V" shape, rupturing the fault line or cut pattern which is located in the vertex of the angle formed by the sides of the "V". The enclosed pouch ruptures along the fault line or cut pattern. Rupturing the plastic at the cut pattern creates a predictably irregular edge with a number of peaks or tongues as well as at least one opening through which the flowable substance is forced upon compression of the flexible side by the relatively stiff sides of the "V" as they are brought together. Advantageously, both the bending and squeezing motions can be performed by the use of only one hand.

While the structure of the 640 patent has been and continues to be commercially successful, it has been found that it may be substantially improved for certain uses. For example, it is often required that the stiff side of the dispenser package be made of a very tough high barrier plastic material or, where the relatively stiff side is constructed of inexpensive, low barrier plastic, have other high barrier materials such as foil or saran, etc. laminated to at least one of its sides to prevent evaporation, leakage, loss of aroma, etc. from the flowable substance contained within. This lamination greatly enhances the barrier properties of the material.

In addition, there are common flowable substances which are corrosive or otherwise active against certain barrier materials, creating specialized packaging and containment requirements. These specialized requirements may simply mean using a thicker or tougher and more expensive material or may involve construction of special multilaminate barriers which are not affected by a particular chemically active flowable substance. By way of example only, iodine is one such flowable substance with specialized packaging requirements. Iodine must be kept in a well sealed container in order to preserve its shelf life, but iodine corrodes some of the most effective and available barrier materials, such as foil. Experimentation has shown that an appropriate barrier for iodine can be constructed by laminating foil to the relatively stiff and inexpensive material, polystyrene, and then coating or laminating a layer of saran to the foil. Although this construction creates a very good barrier, the resultant stiff side and barrier combination is very tough and consequently very difficult to rupture. When the structure of the 640 patent is constructed using such a specialized barrier, it has been found that the bending action often develops insufficient force to rupture the barrier material. Instead, what often happens is that the relatively stiff surface breaks as intended but the barrier layer(s) fails to rupture.

All of the above prior packaging alternatives suffer from a further deficiency in that upon opening, the contents are often dispensed in a generally non-directed stream of flow. The contents of the cuplike plastic containers are meant to be poured or scooped out. Upon squeezing of the envelope-type package, its contents are squeezed out in a direction and an amount which depends on whatever tear opening is created. This usually creates a sloppy oozing of the flowable substance out of the envelope. Finally, although the structure described in the 640 patent performs much better than the previously discussed alternatives in this respect, the flow through the various openings created in the relatively stiff side is not always specifically directed by the openings when the package is bent into a "V".

3. Objects of the Invention

It is therefore an object of this invention to provide a new and improved dispenser package for flowable products.

Another object of this invention is to provide new and improved means for rupturing tough materials or combinations thereof upon their being bent into a "V" shape.

A further object of this invention is to provide a new and improved dispenser package which improves prior dispenser packages in the containment of flowable products in that it is capable of rupturing one or more relatively strong layers of film or barrier material with the use of only one hand.

A still further object of this invention is to provide, in a new and improved dispenser package which improves prior dispenser packages in the containment of flowable products, means for both greatly increasing and concentrating the stress applied to the relatively stiff side to thereby ensure rupture of even relatively tough materials or laminates with a bending action developed by the use of only one hand.

Another object of the present invention is to provide a new and improved dispenser package for flowable products which expels the contents in a highly directed stream upon opening.

A further object of the present invention is to provide a new and improved dispenser package of sufficient structural integrity to contain flowable substances under pressure and yet which may be opened and the contents dispensed in a highly directed flow by the use of only one hand.

Another object of the present invention is to provide a new and improved package for flowable products which is also dripless after having been opened.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps, and improvements herein shown and described.

SUMMARY OF THE INVENTION

Briefly described, the present invention is directed to a new and improved dispenser package for flowable products which may be opened by one hand in a manner to cause controlled rupturing of tough, high barrier packaging materials. The dispenser package of the present invention further provides a highly directed flow of the substance being dispensed and possesses the additional characteristics of being dripless after having been opened.

In accordance with a preferred embodiment of the present invention, the dispenser package comprises a relatively stiff flat side constructed of a tough, high barrier material or a laminate including at least one tough, high barrier layer secured to at least one surface thereof, a flexible arched side secured to the surface of the relatively stiff side to form an enclosed pouch between the flexible arched side and the relatively stiff side, a cut pattern or fault line or other fault area scored or otherwise formed into the relatively stiff side, generally along the transverse center line of that surface, at least one formed dimple or other protrusion, preferably of elongated pyramidal shape, positioned along the fault line.

As used herein, the term "fault line" is intended to encompass the aforesaid alternatives of a cut pattern, a single straight line extending across a portion or all of the relatively stiff flat side or a fault area formed by weakening means other than by a scored continuous line.

In the preferred pyramidal shape, the narrow diagonal axis of the elongated pyramid preferably is in the same line as the fault line. Alternatively, the pyramidal shape may be a polygon having any number of sides. Also alternatively, the protrusion may be conical. For less tough stiff side materials, the dimple may be of other shapes, such as frusto-conical, hemispherical, domed, or oblong, with a variety of cross sections and ends.

In use, the relatively stiff dimpled side of the preferred embodiment of the present invention is bent in half between the thumb and digit fingers, forming a "V" shape with the relatively soft pouch side compressed between the arms of the "V".

It will be understood that the formation of the dimple or other protrusion in the planar surface of the relatively stiff side serves to substantially increase the structural strength of the stiff side material at the dimple. At the same time, the provision of the dimple or other protrusion has the effect of moving the initial point of rupture out of the plane of the relatively stiff side so that, upon folding the ends of the relatively stiff side together about a pivot point in the plane of the relatively stiff side to form a "V", increased leverage is imparted to the crown or outermost portion of the dimple or other protrusion. These factors result in greatly increased rupture forces along the protruding fault line so that even a very tough, high barrier material will break upon folding of the relatively stiff side into a "V" shape. Thus, the very tough, high barrier plastic materials which might normally resist rupture with the rupture forces developed upon folding the ends of the relatively flat stiff side of the 640 patent package into a "V" shape where no protrusion exists have been found to rupture when a protrusion is formed along the fault line. The provision of a dimple or other protrusion, while imparting increased structural strength to the relatively stiff side material at the protrusion also serves to stiffen the material. This effect, in combination with the increased leverage at the crown of the dimple causes the aforesaid folding motion of the package into a "V" to develop sufficient forces along the protruding fault line to rupture or snap the material, causing it to break open.

In addition to shifting the rupture point out of the plane of the relatively stiff side, the pointed pyramidal shape of the preferred embodiment further concentrates the aforementioned rupture forces substantially at a point, further intensifying the ability of the dispenser package of the invention to rupture the tough plastics and foil combinations needed to contain many substances.

It will be seen from the foregoing that the pointed pyramidal shape concentrates the rupture forces at its apex in a manner somewhat analogous to light being focused by a lens.

Thus, in sum: (1) dimpling of the relatively stiff side along the fault line strengthens and stiffens the relatively stiff side at the dimple; (2) dimpling shifts the rupture point out of the plane of the relatively stiff side, resulting in imparting greatly increased leverage to the rupture forces and, hence, increased stress along the fault line; (3) dimpling creates a highly controlled opening permitting increased control of the flow of the contents from the package, as well as its direction, when opened; and (4) utilizing a cone or pyramidally shaped dimple with an apex concentrates the already increased rupturing forces substantially at a point, to thereby further increase the stress generated along the fault line.

As the arms of the "V", comprised of the relatively stiff side, are brought together, the relativey soft sides are compressed, forcing the flowable substance through the opening created by rupturing of the package at the dimple or other protrusion.

It will be seen that multiplying the number of dimples or protrusions will have a variety of effects, either simply multiplying the number of openings or in some cases causing the material between the dimples or protrusions to also rupture, creating a single large opening.

In the embodiment of the invention creating a single large opening, a sponge-like material advantageously may be secured within the pouch in such a fashion that it projects through the opening when the relatively stiff surface is bent into a "V". In this position, part of the sponge-like material remains within the pouch while the center portion projects through the opening. It will be seen that this embodiment of the invention is advantageous for dispensing substances of low viscosity without dripping or running, and also is excellent for use as a swab for medical and other applications. One example of such a use is to provide a sponge applicator for dispensing iodine to the locus of a wound.

In a further unexpectedly advantageous alternative embodiment of the present invention, it has been found that the dispenser package, when constructed of tough materials, whether laminate or homogeneous, is capable of containing and dispensing flowable substances under pressure at least on the order of 10-20 psi. As here embodied, the flexible side of the pouch takes a capsule shape upon becoming pressurized, while the remaining structure is similar to that previously described. The pressurized contents, which may be packaged at reduced or no pressure by filling and sealing the capsule at a low temperature such as 10° F. to 20° F. are accessed using generally the same bending motion as previously described. As the ends of the flexible capsule are brought toward one another, the dimple or other protrusion or protrusions develop sufficient stress to rupture the barrier materials of the tough relatively stiff side of the package, whereupon the pressurized contents quickly flow out of the capsule in a highly directed stream.

It will be apparent from the foregoing general description that the objects of the invention specifically enumerated herein are accomplished by the invention as here embodied.

Thus, as one advantage of the present invention, it was unexpectedly found that tough materials capable of retaining gases under pressure may be used for the package and, when opened, the stress increasing structure results in a highly directed flow of the contained substance through the localized opening. This highly directed flow is created by forcing the flowable substance through the small, localized opening under the considerable pressure generated by the compressed gas in conjunction with the squeezing action of the relatively stiff sides of the "V" upon the pouch containing the flowable substance.

As a further unexpected advantage of the present invention, it also has been found that when the relatively stiff side of the package is constructed of a resilient material, such as polystyrene, it has a tendency to return towards its pre-opened position or, in effect, a less acute angled "V". As a consequence of this action, the flow of the contained flowable substance stops and the substance is drawn back by vacuum action, hence, the opened package does not drip or ooze.

It will be understood that the foregoing general description and the following detailed description as well are exemplary and explanatory of the invention but are not restrictive thereof.

The accompanying drawings, referred to herein and constituting a part hereof, illustrate preferred embodiments of the product of the present invention, and together with the description serve to explain the principles of the invention.

DESCRIPTION OF THE PREFERRED EMBODIMENTS

Figure 1:
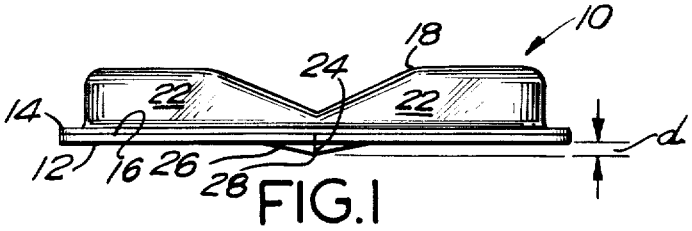
FIG. 1 is a view in elevation of a dispenser package constructed in accordance with a preferred embodiment of the present invention in its pre-opened condition.

Referring now more particularly to FIGS. 1-5 of the accompanying drawings, there is illustrated a first preferred embodiment of a dispenser package constructed in accordance with the present invention, indicated generally by reference numeral 10. As here embodied, package 10 includes a relatively stiff side 12 having a sealant/barrier layer 14 suitably bonded to the inner surface 16 of side 12 so that side 12 and the sealant/barrier layer 14 are rendered integral with one another. Also suitably integrally bonded to the outer perimeter of 12, 14 is a flexible side 18, advantageously formed by conventional means, such as vacuum forming, pressure forming, mechanical forming or combinations thereof.

The bonds between relatively stiff side 12, barrier layer 14 and flexible side 18 can be formed by conventional means, such as welding, heat sealing, or adhesive or cohesive bonding, depending upon the particular properties of the materials used and the flowable substance to be contained.

Advantageously, and as preferably embodied, relatively stiff side 12 is made of polystyrene or polyester or a copolymer thereof, sealant/barrier layer 14 comprises a saran and foil laminate, and flexible side 18 is formed from any suitable flexible plastic sheeting commonly used for wrapping, such as vinyl. Alternatively, sealant/barrier layer 14 may comprise a laminate of foil and vinyl or foil alone, depending upon the nature of the contents to be contained. A particularly tough, high barrier construction comprises saran laminated on each side with polyethylene (sold by Dow Chemical Co. under the name "Saranex") as the sealant/barrier layer 14 laminated onto polystyrene or polyester, forming relatively stiff side 12.

It will be understood to those of ordinary skill in the art that the bonds formed between materials 12, 14 and 18 can be obtained by the conventional means previously described, again depending upon the nature of the flowable substance being contained. These and other equivalent materials and bonding systems are described in the aforementioned 640 patent, the disclosure of which is hereby incorporated by reference.

It will be seen from the foregoing that the structure of FIGS. 1-5 forms an enclosed pouch 22 between flexible side 18 and sealant/barrier layer 14 in which the flowable substance is contained and from which the flowable substance is dispensed.

Figure 2:
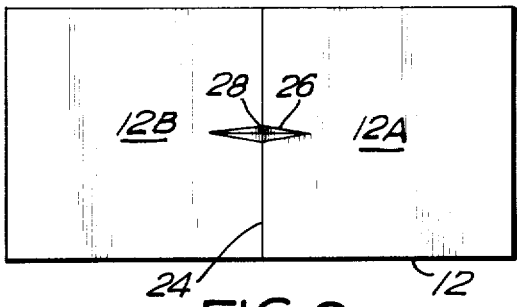
FIG. 2 is a plan view of the dispenser package construction of FIG. 1, the view showing a generally elongated pyramidal shaped protrusion extending from the relatively stiff side thereof having its short diagonal axis along a fault line.
Figure 3:
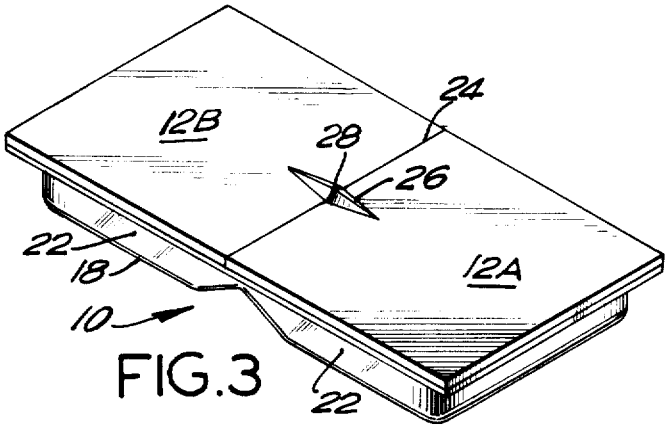
FIG. 3 is a perspective view of FIG. 1.
Figure 4:
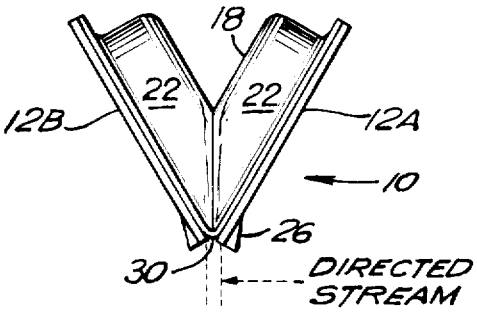
FIG. 4 is a view in elevation of the dispenser package construction of FIG. 1, in an opened condition, bent into a "V" shaped configuration, illustrating a directed stream of contents being expelled from the package.
Figure 5:
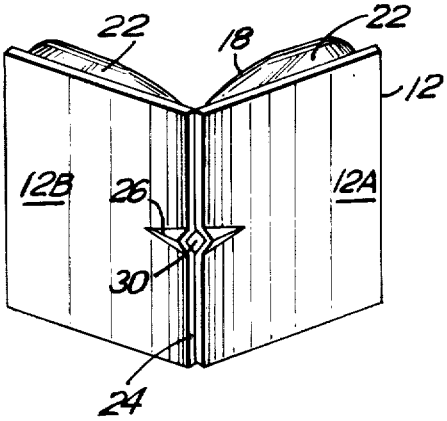
FIG. 5 is a perspective view of the dispenser package construction of FIG. 1, the view illustrating the relatively stiff side of the package in the opened condition shown in FIG. 4.

As best seen in FIGS. 2-3, relatively stiff side 12 of dispenser package 10 is provided with a fault line 24, preferably scored on the outer surface thereof facing away from enclosed pouch 22. Alternatively, as previously mentioned, it will be understood that the present invention is not limited to a linear fault pattern, but rather, the term "fault line" is intended to encompass various fault patterns or areas which may be employed to obtain particular desired results.

In accordance with the invention, a protrusion 26 is formed along fault line 24, projecting outwardly from the outer surface of relatively stiff side 12. As here preferably embodied, protrusion 26 is formed in the shape of an elongated pyramid having diagonal axes connecting the corners of the base of unequal length, with the short diagonal axis on the fault line 24. Although the present invention is not limited to any particular size, it has been found that projection of protrusion 26 to a distance d (see FIG. 1) of approximately one-sixteenth (1/16) of one inch from the outer surface of relatively stiff side 12 operates satisfactorily where the thickness of the stiff side 12 is on the order of approximately 10-12 mils.

It will be seen from the foregoing, and particularly FIGS. 2A-2B and 4-5, that fault line 24 acts as a guide for controlled fracturing of relatively stiff side 12 as package 10 is bent into a "V" shape about an axis parallel to the fracture along fault line 24. Thus, as relatively stiff side 12 is bent into a "V" shaped configuration, stress is concentrated at the apex 28 of protrusion 26 by leverage attributable to the distance of the apex 28 from the bending axis. In effect, an axis along the inner surface of relatively stiff side 12 acts as a fulcrum for developing leveraging power, and consequently increased stress, at apex 28. It has been unexpectedly found that the aforesaid concentrated stress causes apex 28 to fracture with sufficient force to simultaneously rupture that portion of sealant/barrier 14 which is in direct contact with protrusion 26 and integral therewith, forming an exit aperture 30.

Concurrent with the fracture of apex 28 and protrusion 26, fault line 24 also fractures. However, as pointed out earlier, when the sealant/barrier layer 14 is formed of a tough, high barrier construction the stress exerted along fault line 24 during fracture is not sufficient to rupture the sealant/barrier layer 14 juxtaposed thereto which serves to hinge stiff side 12 together after fracture of protrusion 26. Thus, as the two side halves 12A, 12B of relatively stiff side 12 are forced toward a parallel and overlapping position, the side halves 12A, 12B cooperate with flexible side 18 to force the contained flowable substance through exit aperture 30. Since the sealant/barrier layer 14 has not ruptured along fault line 24 except along protrusion 26, exit aperture 30 is the only opening from which the contained flowable substance can exit.

It will be apparent from the foregoing that the localized opening created at exit aperture 30 creates a highly directed stream of the flowable substance as the rigid side halves 12A, 12B act cooperatively with flexible side 18 to expel the contents from pouch 22. The highly directed stream is created by forcing the flowable substance through a relatively small opening under relatively considerable pressure.

Figure 2A:
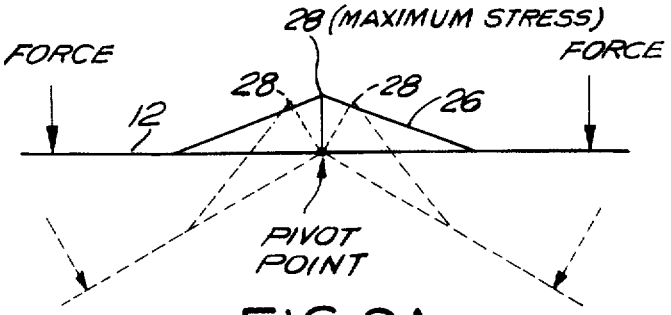
FIG. 2A is an enlarged schematic view of the relatively stiff side of the dispenser package construction of FIG. 1, the view illustrating the focus of the rupture forces at the apex of the pyramidal shaped protrusion.
Figure 2B:
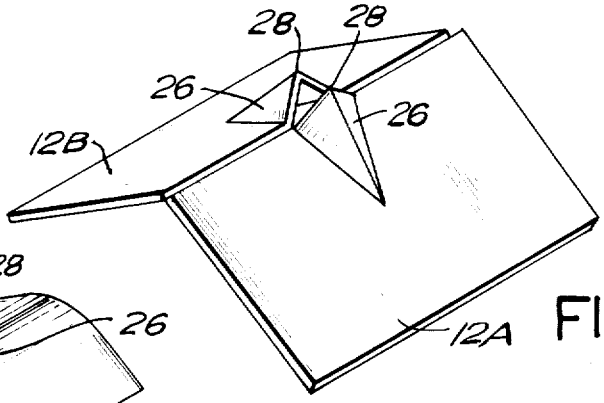
FIG. 2B is an enlarged perspective view similar to FIG. 2A illustrating the ruptured apex of the pyramidal shaped protrusion.
Figure 2C:
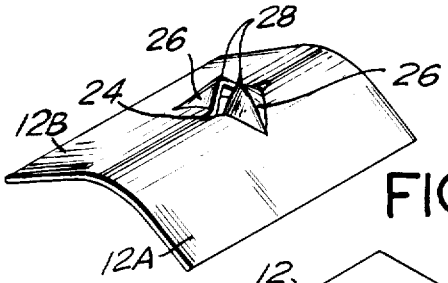
FIG. 2C is an enlarged perspective view similar to FIG. 2A illustrating the ruptured apex of the pyramidal shaped protrusion where the fault line extends across substantially only the upwardly extending sides and apex of the protrusion.

It will be understood that the same effect as just described may be obtained by forming the fault line 24 substantially only across protrusion 26, as shown in FIG. 2C. Alternatively, fault line 24 may extend beyond protrusion 26 but not to the edge of the package.

It has been unexpectedly found that after some or all of the flowable substance has been removed from pouch 22, rigid halves 12A, 12B have a tendency to return toward their pre-opened position, assuming a "V" shape which is of a less acute angle than during dispensing. Simultaneous and consequent to the return of relatively stiff side 12 toward its original position, pouch 22 is partially re-expanded, creating an influx at exit aperture 30. The simultaneous return of halves 12A, 12B toward their pre-opened position and influx through aperture 30 tend to cause any flowable substance remaining in the area of exit aperture 30 to be sucked back into pouch 22 and thereafter terminates any further outward flow. Thus, it will be seen that the package of the present invention also has the unusual and desirable advantage that it does not drip or ooze after dispensing only a part of the contents. Of course, dispensing of the remaining portion of the flowable substance can be recommenced when desired.

Figure 6:
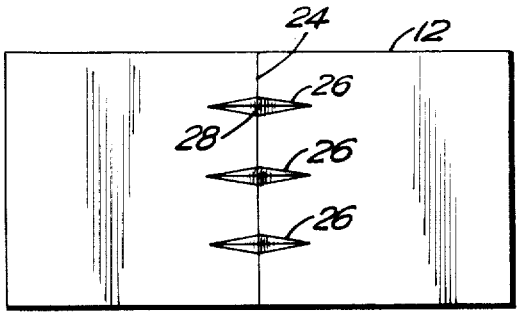
FIG. 6 is a plan view of an alternative embodiment of the invention shown in FIG. 1, in which a plurality of protrusions of elongated pyramidal shape extend from the relatively stiff side of the dispenser package.

Referring now more particularly to FIG. 6 of the accompanying drawings, there is shown an alternative embodiment of the dispenser package construction of FIGS. 1-5, wherein a plurality of protrusions 26 are formed along fault line 24, so as to provide additional leverage for rupturing sealant/barrier 14 and multiple exit apertures.

It will be understood that construction of relatively stiff side 12 with protrusions 26 may be advantageous even when no extra sealant/barrier layer 14 is required and such construction is within the scope of the present invention. As previously described in connection with the use of a localized fault line, such a construction may be particularly desirable in dispensing low viscosity flowable substances such as water, cream or alcohol in a highly directed stream from a dripless package. Such flowable substances do not require a special sealant barrier layer and yet are appropriate substances for a dispenser having the other advantages of the present invention.

Figure 7A:
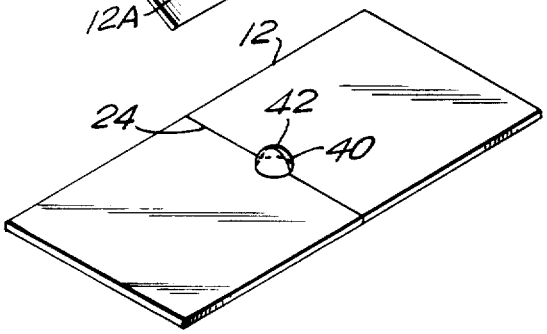
FIGS. 7A and 7B are perspective views of further alternative embodiments of the invention shown in FIG. 1, FIG. 7A illustrating a domed protrusion and FIG. 7B illustrating the elongated pyramidal protrusion formed so that its long diagonal axis is on the fault line.
Figure 7B:
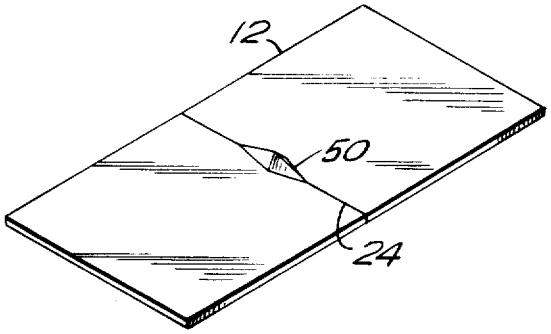

Referring now more particularly to FIGS. 7A and 7B of the accompanying drawings, there are illustrated alternative embodiments for the shape of the protrusion extending from the relatively stiff side 12 of a dispenser package constructed in accordance with the invention. In FIG. 7A protrusion 40 is generally rounded or dome-like in shape. Fault line 24 bisects domed protrusion 40 along its curved sides and across the center of its top surface 42. FIG. 7B shows an elongated pyramidal protrusion 50 similar to that shown in FIGS. 1-5 at 26 positioned such that fault line 24 bisects the protrusion 50 along its long axis.

Figure 7C:
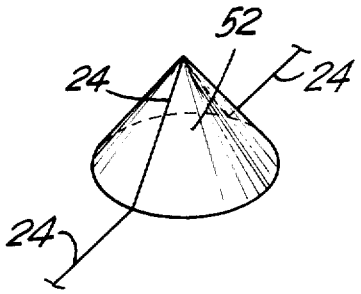
FIGS. 7C, 7D and 7E are fragmentary schematic views of still further alternative embodiments of the shape of the protrusion, FIG. 7C illustrating a conical shape, FIG. 7D, illustrating a frusto-conical shape and FIG. 7E illustrating a four-sided pyramid where the diagonal axes connecting the corners of the base are of equal length.
Figure 7D:
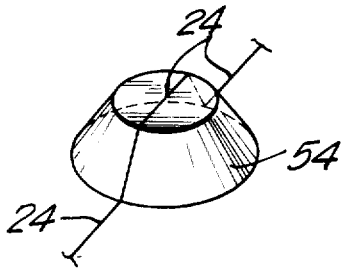
Figure 7E:
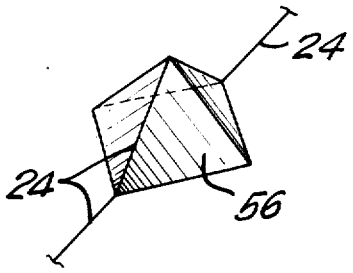

Referring now more particularly to FIGS. 7C-7E, still further alternative embodiments of the shape for the protrusion are illustrated. Thus, there is shown in FIG. 7C a conical protrusion 52 bisected by fault line 24; in FIG. 7D a frusto-conical protrusion 54 bisected by fault line 24; and, in FIG. 7E, a pyramid 56 having a four-sided base where the diagonal axes connecting the corners of the base are of equal length, bisected by fault line 24 on one diagonal axis. As previously discussed, it will be seen that the structures of FIGS. 7C and 7E concentrate the rupturing forces substantially at a point for maximum stress and rupturability.

Figure 8:
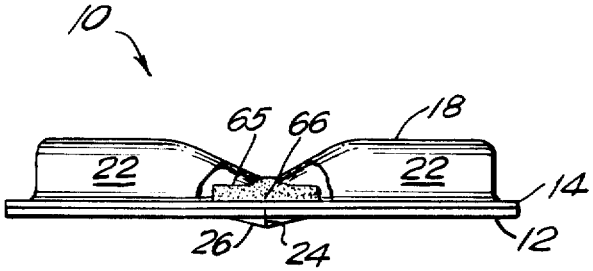
FIG. 8 is a view in elevation, partly fragmentary, of another alternative embodiment of the present invention, wherein the dispenser package construction of FIG. 1 contains an internal applicator formed from a sponge-like material having a compressed center portion adapted to project from the package upon opening.
Figure 9:
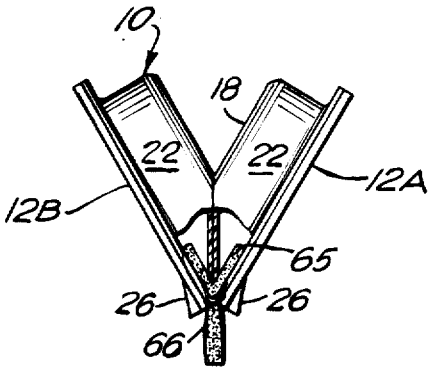
FIG. 9 is a view in elevation, partly fragmentary, of the alternative embodiment of the invention shown in FIG. 8 in an opened condition, bent into a "V" shaped configuration and having a portion of the sponge-like material protruding from the opening.

Referring now more particularly to FIGS. 8 and 9 of the accompanying drawings, there is illustrated a further modification of the dispenser package of FIGS. 1-5, wherein liquid applicator means are provided within pouch 22 for applying the contents of the package to the desired use. To that end, as here embodied, a sponge 65 or other suitable absorbent or sponge-like material is secured within pouch 22 directly behind hollow protrusion 26 and score line 24. Advantageously, sponge 65 is formed with a projecting center portion 66 which is compressed within package 10 in its pre-opened condition. FIG. 9 shows a dispenser package 10 and sponge 65 in use. Thus, when relatively stiff side 12 is bent into a V-shaped configuration, exit aperture 30 is formed by the fracture of protrusion 26 and the rupture of sealant/barrier layer 14 (if one is used). Simultaneously with the formation of exit aperture 30, the compressed portion 66 of sponge 65 is released through exit aperture 30. The remainder of sponge 65 remains within pouch 22 during use to absorb and transport, in the manner of a wick, the flowable substance to the portion 66 of sponge 65 protruding from exit aperture 30.

Figure 10:
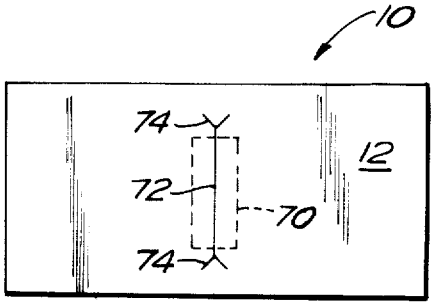
FIGS. 10 and 11 are plan views of other alternative embodiments of the present invention showing an internal sponge member positioned adjacent the inside surface of the relatively stiff side, FIG. 10 showing a single fault line extending across only a portion of the relatively stiff side, terminating at each end in a V-shaped score and FIG. 11 showing an elongated protrusion extending longitudinally of the fault line.
Figure 11:
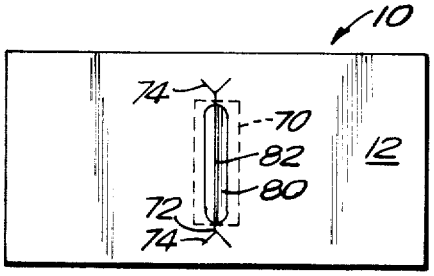

Referring now more particularly to FIGS. 10 and 11 of the accompanying drawings, there are illustrated other alternative embodiments constructed in accordance with the invention. Thus, in FIG. 11 there is illustrated a dispenser package 10 constructed such that a sponge 70 or other suitable absorbent or sponge-like material is positioned within pouch 22 directly behind a fault line 72. As here embodied, fault line 72 extends only partially across the relatively stiff side 12 of package 10, each end of which terminates in a diverging V-shaped fault line 74. It will be seen that as here embodied upon bending of the ends of relatively stiff side 12, rupture of fault lines 72, 74 creates a relatively wide, slot-like opening through which sponge 70 or the like may easily protrude for swabbing, scrubbing or the like.

FIG. 11 is constructed similar to FIG. 10, except that an elongated protrusion 80 is also formed longitudinally of fault lines 72, 74. As here embodied, protrusion 80 is preferably triangularly shaped in cross section terminating along a linear apex 82. It will of course be understood from the foregoing that provision of protrusion 80 along fault line 72 more effectively facilitates both rupture of a sealant/barrier layer 14 provided on the inner surface of stiff side 12 and also facilitates projection of sponge 70 by creating a continuous exit aperture.

Figure 12:
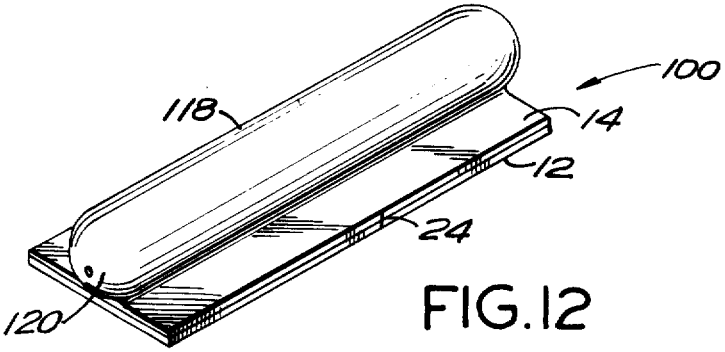
FIG. 12 is a perspective view of yet another alternative embodiment in accordance with the present invention, wherein the flexible side is generally cylindrical in shape and the package is constructed so as to hold the contents under pressure.
Figure 13:
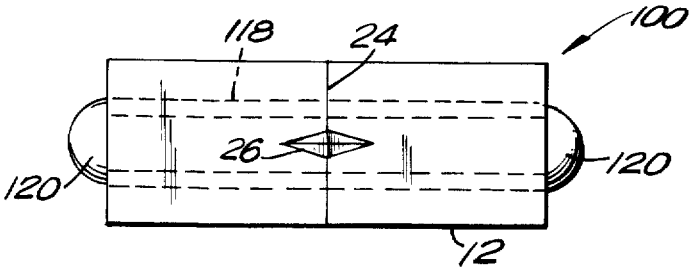
FIG. 13 is a plan view of the embodiment shown in FIG. 12, illustrating the relatively stiff side thereof in its pre-opened condition.

Referring now more particularly to FIGS. 12–13 of the accompanying drawings, there is illustrated a further embodiment of a dispenser package constructed in accordance with the present invention, indicated generally by reference numeral 100. As here embodied, package 100 includes a relatively stiff side 12 having secured thereto a suitable sealant/barrier layer 14, as previously described but preferably comprising either a foil and saran or a foil and vinyl laminate, as well as fault line 24 and protrusion 26. As here embodied, however, a flexible side 118 is preferably generally cylindrically shaped and has symmetrical domed ends 120. Advantageously, flexible side 118 is vacuum formed from a suitable plastic material, and is suitably bonded to 12, 14, so as to have sufficient structural integrity to contain flowable substances under pressure.

Thus, it has been unexpectedly found that the use of protrusion 26 to generate sufficient force to rupture such strong and durable sealant/barrier materials as saran and vinyl has the added unexpected advantage that the dispenser package construction of the invention permits flowable substances to be held under pressure, enabling usage for such substances as shaving cream, whipped cream and pie frostings. Countless other packaging uses will be understood to persons of ordinary skill in the commercial packaging industry.

It has been found that the foregoing material will satisfactorily withstand pressure up to on the order of at least 10–20 psi, which is sufficient for many commercial packaging uses.

Advantageously, the contents of dispenser package 100 may be placed into the packages at a low temperature, on the order of between 10° F. and 20° F., to reduce or eliminate the pressure exerted upon the construction materials during packaging. Of course, if the container is to be filled at a low temperature a heat sealing process cannot be used to bond flexible side 118 to relatively stiff side 12 and sealant/barrier layer 14. Similarly, if an aerosol propellant is desired to be used which is flammable, a heat sealing process would be inappropriate. In these situations, a suitable adhesive or cohesive material should be utilized, as previously disclosed or other welding means such as ultrasonics or radio frequency.

To the extent not already indicated, it also will be understood by those of ordinary skill in the art that any one of the various specific embodiments herein described and illustrated may be further modified to incorporate features shown in other of the specific embodiments, as desired.

The invention in its broader aspects therefore is not limited to the specific embodiments herein shown and described but departures may be made therefrom within the scope of the accompanying claims, without departing from the principles of the invention and without sacrificing its chief advantages.

What is claimed is:

1. A dispensing package for a flowable substance, said package including a relatively stiff substantially flat sheet and flexible sheet secured to one face of said relatively stiff substantially flat sheet, said flexible sheet forming a pocket adjacent said one face of said relatively stiff substantially flat sheet for containing a flowable substance, said relatively stiff substantially flat sheet having a fault line of predetermined length, protrusion means displacing at least a portion of said fault line out of the plane of said relatively stiff substantially flat sheet in a direction away from said one face for substantially maximally increasing the stress in said relatively stiff substantially flat sheet at the displaced portion of said fault line, whereby upon bending said relatively stiff substantially flat sheet into a "V" about an axis extending along said fault line so that the arms of said "V" encapture said pocket, said fault line initially ruptures at the locus of said protrusion means to create at least one opening through which said flowable substance is dispensed in a directed flow, said protrusion means having a configuration which is substantially symmetrical on either side of said fault line and on either side of an axis normal to said fault line and in which the point of greatest displacement is located substantially on said fault line.

2. A dispensing package as claimed in claim 1, including a plurality of said protrusion means spaced apart along said fault line to create a plurality of openings along said fault line upon bending said relatively stiff substantially flat sheet into said "V".

3. A dispensing package as claimed in claim 2, wherein said plurality of said protrusion means are spaced sufficiently close together to cause said fault line to tear between each of said plurality of openings so as to create at least one opening of increased width along said fault line.

4. A dispensing package as claimed in claim 1, wherein said protrusion means has a peaked cross-sectional shape along said fault line.

5. A dispensing package as claimed in claim 4, wherein said protrusion means comprises a conical configuration and said fault line substantially bisects said conical configuration.

6. A dispensing package as claimed in claim 4, wherein said protrusion means comprises a substantially pyramidal configuration and said fault line is displaced from said relatively stiff flat sheet material across the apex of said substantially pyramidal configuration.

7. A dispensing package as claimed in claim 6, wherein said substantially pyramidal configuration has diagonal axes of unequal length, the shorter axis extending substantially along said fault line so that said fault line is displaced across the apex of said substantially pyramidal configuration along said shorter axis.

8. A dispensing package as claimed in claim 7, wherein said substantially pyramidal configuration has four flat sides, and wherein said diagonal axes connect the corners of the base formed by the bottoms of said four flat sides.

9. A dispensing package as claimed in claim 6, wherein said substantially pyramidal configuration has diagonal axes of unequal length, the longer axis extending substantially along said fault line so that said fault line is displaced across the apex of said substantially pyramidal configuration along said longer axis.

10. A dispensing package as claimed in claim 4, wherein said protrusion means has a peaked cross-sectional shape at substantially all cross-sections extending vertically therethrough parallel to said fault line.

11. A dispensing package as claimed in claim 1, wherein said relatively stiff flat sheet includes a foil barrier material.

12. A dispensing package as claimed in claim 1, wherein said relatively stiff sheet includes a plastic barrier material.

13. A dispensing package as claimed in claim 1, wherein said relatively stiff flat sheet includes both foil and plastic barrier materials.

14. A dispensing package as claimed in claim 1 including an absorbent material saturated with said flowable substance which is adapted to protrude from said package through said at least one opening to form a swab for use in the application of said flowable substance.

15. A dispensing package as claimed in claim 14, wherein said absorbent material comprises a sponge having a projecting portion which is compressed within said package immediately adjacent said protrusion means, whereby when said at least one opening is created said projecting portion of said sponge is released through said opening to form said swab.

16. A dispensing package as claimed in claim 1 wherein said package is internally pressurized.

* * * * *